US005285939A

United States Patent [19]

Hogan

[11] Patent Number: 5,285,939

[45] Date of Patent: Feb. 15, 1994

[54] SLING FOR HOLDING AND CARRYING BOOTS

[76] Inventor: Darryl G. Hogan, 18013 S.E. Blanton St., Milwaukie, Oreg. 97267

[21] Appl. No.: 927,812

[22] Filed: Aug. 10, 1992

[51] Int. Cl.[5] ..... B65D 71/00

[52] U.S. Cl. ..... 224/250; 224/205

[58] Field of Search ..... 224/205, 250, 251, 257

[56] References Cited

U.S. PATENT DOCUMENTS

| | | | |
|---|---|---|---|
| 3,023,941 | 3/1962 | Foley | 224/205 |
| 3,600,734 | 8/1971 | Pollinger | 12/120.5 |
| 3,923,222 | 12/1975 | Groves | 224/250 X |
| 4,057,757 | 11/1977 | Darden, Jr. | 224/205 X |
| 4,127,223 | 11/1978 | Uchin | 224/250 X |
| 4,629,103 | 12/1986 | Miller | 224/250 |
| 4,790,462 | 12/1988 | Kawaguchi | 224/250 |
| 4,867,359 | 9/1989 | Donovan | 224/202 |
| 4,942,994 | 7/1990 | Sterenberg | 224/247 |
| 5,147,079 | 9/1992 | Heather | 224/257 X |

*Primary Examiner*—Renee S. Luebke

*Attorney, Agent, or Firm*—Edward B. Watters

[57] ABSTRACT

A light weight and easily stored sling for holding and carrying a pair of boots, particularly ski boots, in side-by-side relation. A large, closed-loop strap, preferably of nylon webbing, surrounds the boots laterally, the upper part of the loop forming a carrying strap. A second, smaller, open-loop strap transverse the first strap and affixed to it on the sides receives the boot tops, loops around and encloses them by means of a fastener, and holds the boots in the sling. The sling is readily carried by hand or over the shoulder, and its configuration prevents heavy boots from separating, rotating or flailing about when jostled.

13 Claims, 1 Drawing Sheet

SLING FOR HOLDING AND CARRYING BOOTS

BACKGROUND OF THE INVENTION

The present invention relates to article carriers, and more particularly, to a sling for holding and carrying a pair of boots.

Modern ski boots, notably those used for downhill and competitive skiing, particularly alpine events, are large, stiff and inflexible, being suitably made from high impact plastic. Such ski boots are constructed with a boot top that extends well above the wearers ankle, the boot top being raked forward from the perpendicular, with respect to the sole of the boot, such that during downhill skiing the wearer can readily and effortlessly assume a lowered or crouched body stance, or a tuck for schuss. However, the forwardly inclined attitude of the boot top makes walking in the boots difficult and cumbrous, and accordingly, unless on the ski slopes, the boots are normally removed and carried, in favor of wearing lighter weight, conventional footwear.

Available boot carriers include a strand of cord, with ends attached to a hand grip or handle, the cord being reeved beneath straps or other fastening members of each boot top. However, such carriers allow the boots to dangle from and rotate about the cord, flailing about freely with respect to each other, making the boots awkward to carry.

Other kinds of boot carriers provide separate strapping means to hold each boot individually, the strapping means being attached to opposite ends of another, elongate strap, which is slung over the shoulder of the skier with one boot in front and the other in back. This type of carrier can also allow heavy boots to dangle somewhat freely and perhaps swing out of control and fall. A variation of this type of device fastens the individual strapping means together to form a hand-held carrier similar to that described in the previous paragraph.

Still other boot carriers employ frames or other devices of metal or rigid plastic, such as retainers receiving the toe or heel portions of a boot for clamping the boots together in juxtaposed relation, and providing a centrally disposed carrying strap, or a shaft with a hand grip, which generally extend upward and emerge from between the joined boots. Skiers find that rigid devices are difficult or unwieldy to store on their person while skiing, and centrally located carrying means can dispose the boots to rotation when jostled.

Accordingly, it is a primary object of the present invention to provide an improved sling for supporting, holding and carrying a pair of boots of the type reaching at least well up the calf of the leg.

It is another object of the present invention to provide an improved sling for supporting, holding and carrying a pair of boots in juxtaposed relation.

Another object of the invention is to provide an improved sling for supporting, holding and carrying in juxtaposed relation a pair of ski boots.

Yet another object of the invention is to provide an improved sling for supporting, holding and carrying a pair of boots, which sling is light in weight, compact in size, and simple and inexpensive to manufacture.

Another object of the invention is to provide an improved sling for supporting, holding and carrying a pair of boots in a manner which prevents the boots from rotating or flailing about when jostled.

SUMMARY OF THE INVENTION

These and other objects of my invention are achieved in accordance with one aspect thereof by providing a sling having a first strap forming a closed loop with a base underlying the soles of a pair of boots placed side by side in the sling, the sides of the loop extending upward from the base along the outer sides of the boot tops, and extending further thereabove to form a carrying strap. A second strap forming an open loop with a closure is transversely oriented with the first strap and affixed thereto at intersections of the straps on either side, the second strap being adapted to receive the juxtaposed boot tops in the open loop, and encircle their outer periphery when the closure is fastened to hold the boots in the sling.

Adapted for carrying heavy ski boots, the first and second straps of the sling can be affixed with respect to each other at an angle off normal commensurate with the forwardly raked angular orientation typical of the boot tops of ski boots.

BRIEF DESCRIPTION OF THE DRAWING

While the invention is set forth with particularity in the appended claims, other objects, features and advantages of the invention will become more apparent, and the invention will best be understood by referring to the following detailed description in conjunction with the accompanying drawing in which:

DESCRIPTION OF THE PREFERRED EMBODIMENT

Figure 1:
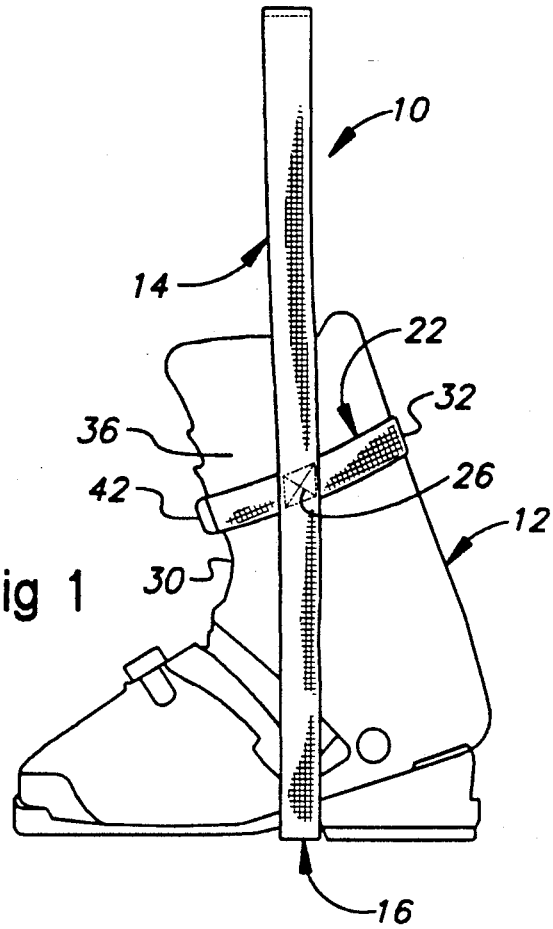
FIG. 1 illustrates a pair of ski boots held in a sling in accordance with the instant invention.
Figure 2:
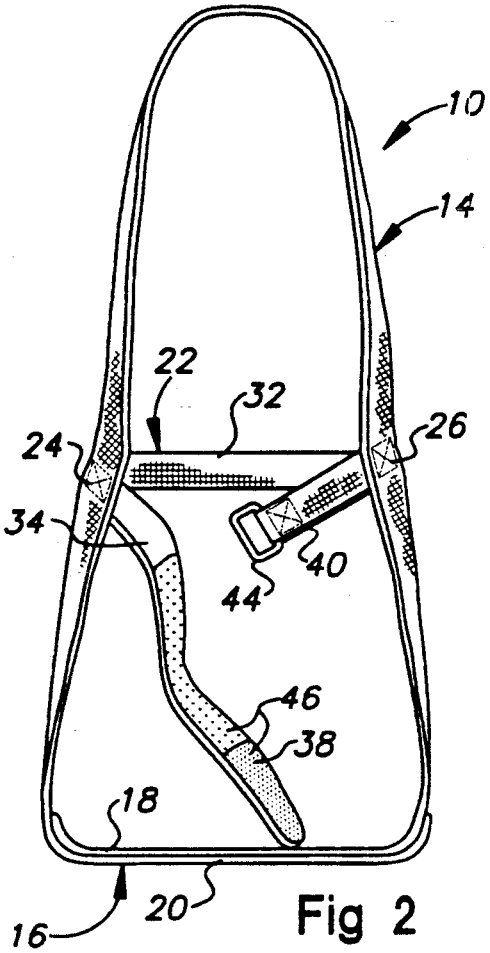
FIG. 2 is a front perspective view of a sling for holding and carrying boots according to the present invention, the sling shown in the open configuration for receiving a pair of boots therein.

Referring now to the various views of the drawing for a more detailed description of the components, materials, construction, function, and other features of the instant invention by characters of reference, and in which like characters denote like elements throughout the several views, FIGS. 1 and 2 illustrate a sling 10 adapted to hold and carry a pair of boots 12 in side-by-side relation. The sling 10 comprises a first, vertically oriented strap 14 suitably formed from webbing or other strapping material into a closed loop laterally encircling the boots 12. A base portion 16 of the strap 14 is reinforced by a double thickness of the strapping material, one layer of strapping 18 overlaying the other layer 20, the layers 18, 20 joined as by sewing. Thus reinforced, the base 16 remains somewhat stiff and straight when the boots are removed from the sling, which holds the looped strap 14 open at the base 16 and facilitates emplacing the boots 12 in the proper position in the sling 10.

A second strap 22 in the form of an open loop is disposed transversely to the first, vertically oriented strap 14 and affixed thereto as by stitching at points of intersection 24, 26 on either side of the strap 14. The second strap 22 is adapted to be closed around the outer periphery of the tops of boots emplaced in the sling, and when so closed, the second strap lies generally in a plane normal to the plane in which the first strap generally lies. The second strap 22 is affixed normal to the first strap 14 for use with most high-top boots such as cowboy boots and hunting boots. However, heavy modern ski boots are constructed with a boot top which is raked forward from the perpendicular with respect to the sole of the boot; therefore, for use with such ski boots, the second strap 22 is tilted at an angle with respect to the vertically oriented strap 14 commensurable with the forwardly inclined angular orientation typical of the boot top of a ski boot, as best illustrated in FIG. 1. While the angular orientation of the straps is important for preventing stress on the stitched joints 24, 26, when the sling is used for carrying heavy ski boots, the degree of tilt of the straps 14, 22 from normal is not critical; I have found that an angular orientation of seven to ten degrees from normal provides the best fit for most ski boots. Further, the transverse strap 22 is positioned high enough on the strap 14 so that the transverse strap 22 encircles and holds the boot tops at a position above the arcuate widening at the ankle 30 of the ski boots.

Figure 3:
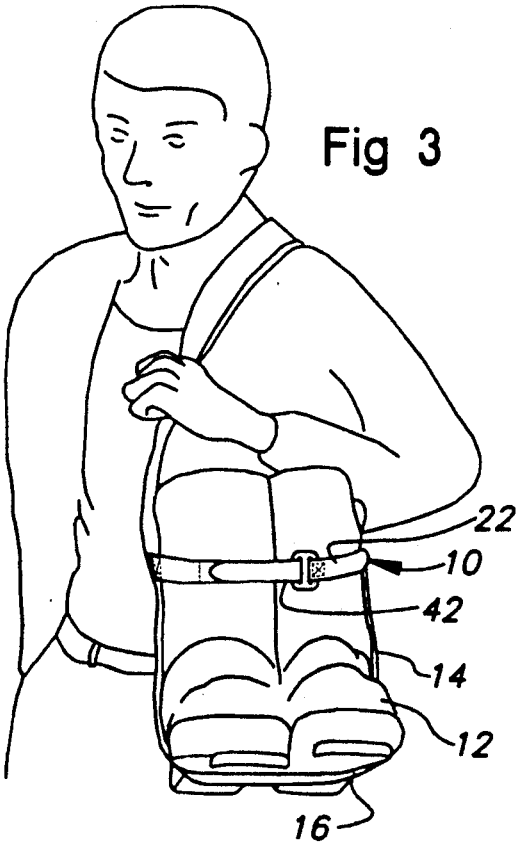
FIG. 3 illustrates the use of the sling of FIG. 2 in carrying a pair of boots on the shoulder.

A retral portion 32 of the transverse strap 22 is continuous between the points of intersection 24, 26, and an anterior portion 34 discontinuous or open, thus to receive and enclose the juxtaposed boot tops 36. Ends 38, 40 of the transverse strap 22 are provided with a fastening member 42, suitably a ring 44 attached to the end 40 as by stitching, the other end 38 being passed through the ring 44 and folded back on itself for attachment by hook and loop fastening elements 46, which secures the strap 22 around the boot tops 36, as best illustrated in FIGS. 1 and 3. Alternatively, the ring 44 can be eliminated and the ends 38, 40 fastened together with hook and loop fastening members.

The sling 10 is suitably made from nylon webbing 2.5 centimeters (1 inch) wide, having a thickness of approximately 2 millimeters (5/64 inch). Other materials and combinations of materials can be used, but nylon webbing is the preferred material. The strap 14 is formed in a closed loop having a circumference typically of 1.65 meters (65 inches), with 61 centimeters (24 inches) of webbing disposed below the stitched intersections 24, 26, and 104 centimeters (41 inches) of webbing above the stitching 24, 26. The stiffened base 16 is typically 22 centimeters (8⅝ inches) in length. The retral portion 32 of the transverse strap 22 is typically 38 centimeters (15 inches) in length between the stitched intersections 24, 26, the strap 22 being adapted to enclose and hold a pair of boot tops having a perimeter of about 73 centimeters (28¾ inches). The strap end 40 is typically 12 centimeters (4¾ inches) from the stitching 26 to the ring 44, while the strap end 38 is suitably 35 centimeters long (13¾ inches) from stitching 24 to tip. The foregoing dimensions suitably accommodate a pair of ski boots of large size. Adjustments of size of the sling 10, particularly the length of the transverse strap 22 and the length of strapping disposed below the stitching points 24, 26, i.e., lengthening for larger size boots and shortening for smaller sizes, can be made in order to accommodate a wide range of boot sizes. I have found that a range of four sizes of the sling 10 will provide a proper fit for virtually every size of ski boot manufactured. Alternatively, the straps 14, 22 can be made of adjustable length, for example by the use of triple bar slides and D-rings; however, the preferred embodiment of the sling utilizes fixed-length straps.

Figure 4:
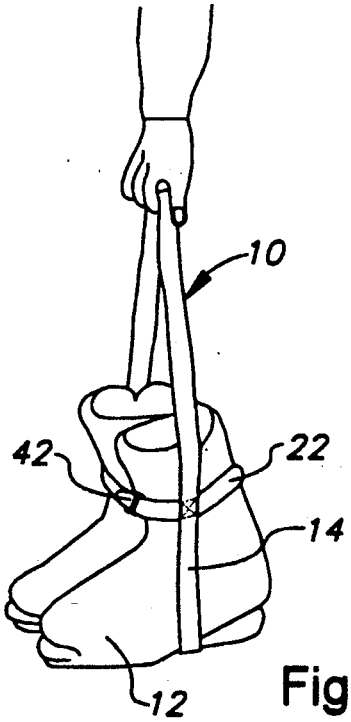
FIG. 4 illustrates the use of the sling of FIG. 2 in carrying a pair of boots by hand.

When the boots 12 are emplaced in the sling 10, as illustrated in FIG. 1, the base 16 of the first strap 14 subtends the soles of the boots, forward of the heels, and extends up the outer sides of the juxtaposed boots. The transverse strap 22 fastens around the boot tops, and the upper portion of the first strap 14 extends above the boot tops and forms a carrying strap, which can be held by hand, as illustrated in FIG. 4, or slung over the shoulder, as shown in FIG. 3. The angular orientation of the straps 14, 22 facilitates positioning the vertically oriented strap 14 over the center of gravity of heavy ski boots, while the triangular configuration of the carrying strap, which proceeds from the outer sides of the boot tops, provides positive control of the boots and prevents the boots from rotating or flailing about, even when jostled. The sling 10 is light, compact and easily folded for storage, for example in the pocket of the skier, and is easily and inexpensively manufactured, having fewer hardware elements than other boot carriers.

While the principles of the invention have been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

I claim:

1. A sling for supporting, holding and carrying a pair of boots juxtaposed, comprising:

a first strap defining a closed loop and having a stiffened base portion adapted to underlie the pair of boots emplaced upright and juxtaposed in said sling, opposite sides of said first strap extending upward from said stiffened based portion along respective outer sides of the boot tops, said opposite sides extending further upward above the boot tops where said loop forms a carrying strap; and a second strap defining an open loop and having a closure adapted to close said second strap in a loop around both the boot tops of the juxtaposed boots, said second strap being transverse said first strap and affixed to said first strap at points of intersection on said opposite sides of said first strap, said stiffened base portion holding said opposite sides of said first strap spaced apart when the boots are removed from said sling and said sling is held by said carrying strap, whereby the boots can be emplaced in said sling between said spaced apart sides.

2. The sling according to claim 1 wherein said second strap lies generally in a plane normal to a plane in which said first strap generally lies.

3. The sling according to claim 1 wherein said second strap is oriented at an angle with said first strap commensurable with a forwardly inclined attitude of alpine ski boots.

4. The sling according to claim 1 wherein said second strap is oriented at an angle with said first strap, the angle being in a range from seven to ten degrees from normal.

5. The sling according to claim 1 wherein said first strap and said second strap comprise webbing sewn together at said points of intersection.

6. The sling according to claim 1 wherein said closure of said second strap comprises hook and loop fastening elements.

7. A sling for high-top boots, comprising:

first closed-loop strap means for supporting, holding and carrying a pair of high-top boots in juxtaposed relation, said first strap means being looped laterally around the boots and including a stiffened base portion underlying the juxtaposed boots, outer sides of said first strap means extending upward along outer sides of the boot tops and further extending above the boot tops where said first closed-loop strap means further defines means which can be grasped for carrying the boots;

second open-loop strap means for receiving, surrounding and holding the juxtaposed boot tops, said second strap means oriented generally crosswise with said first strap means and affixed to said first strap means at intersections therewith at both said outer sides; and means for closing said second open-loop strap means around the juxtaposed boot tops, said stiffened base portion holding said outer sides of said first strap means spaced apart when the boots are removed from said sling and said sling is held by said carrying means, whereby the boots can be emplaced in said sling between said spaced apart outer sides.

8. The sling according to claim 7 wherein said second open-loop strap means lies generally in a plane normal to a plane in which said first closed-loop strap means generally lies.

9. The sling according to claim 7 wherein said second open-loop strap means is oriented at an angle with said first closed-loop strap means commensurable with a forwardly inclined attitude of alpine ski boots.

10. The sling according to claim 7 wherein said second open-loop strap means is oriented at an angle with said first closed-loop strap means, the angle being in a range from seven to ten degrees from normal.

11. The sling according to claim 7 wherein said first closed-loop strap means and said second open-loop strap means comprise webbing sewn together at said intersections.

12. The sling according to claim 7 wherein said closing means comprises hook and loop fastening elements.

13. A sling for supporting, holding and carrying a pair of ski boots, the sling comprising:

a first strap of webbing formed into a closed loop adapted to laterally encircle the pair of ski boots emplaced upright and juxtaposed in the sling, the strap having a base portion stiffened by one thickness of the webbing overlying and attached to another thickness of the webbing, the stiffened base portion underlying juxtaposed soles of the pair of ski boots, outer sides of the closed loop of the first strap extending upward from the base portion along respective outer sides of the boots and boot tops, the outer sides of the closed loop further extending above the boot tops where the closed loop defines a carrier portion which can be grasped for carrying the boots; and a second strap of webbing formed into an open loop and having a closure adapted to close and loop the second strap around both the boot tops of the juxtaposed boots, the second strap being affixed in transverse relation to the first strap on opposite sides of the open loop at respective intersections on the outer sides of the first strap, the second strap having a retral portion and an anterior portion, the retral portion being continuous between the intersections and the anterior portion being discontinuous between the intersections, the closure being adapted to close the discontinuous anterior portion of the second strap, the second strap being oriented with respect to the first strap at an angle commensurable with a forwardly inclined attitude of ski boots, the stiffened base portion holding the outer sides of the closed loop of the first strap spaced apart when the boots are removed from the sling and the sling is held by the carrier portion, whereby the boots can be emplaced in the sling between the spaced apart outer sides.

* * * * *